United States Patent [19]

Pieperhoff

[11] Patent Number: 5,062,759

[45] Date of Patent: Nov. 5, 1991

[54] SAFETY CIRCUIT ARRANGEMENT FOR LIFTING/TILTING OR TILTING DEVICES

[75] Inventor: Hans J. Pieperhoff, Mainz Laubenheim, Fed. Rep. of Germany

[73] Assignee: Zöller-Kipper GmbH, Mainz-Laubenheim, Fed. Rep. of Germany

[21] Appl. No.: 503,442

[22] Filed: Mar. 30, 1990

[30] Foreign Application Priority Data

Apr. 3, 1989 [DE] Fed. Rep. of Germany ..... 3910660

[51] Int. Cl.[5] ..... B65F 3/04

[52] U.S. Cl. ..... 414/408; 414/730; 414/409; 414/21; 414/406; 298/22 C; 901/46

[58] Field of Search ..... 414/403, 404, 406, 407, 414/540, 408, 409, 419, 420, 421, 422, 423, 424, 730, 21; 901/33, 46, 47

[56] References Cited

U.S. PATENT DOCUMENTS

| | | | |
|---|---|---|---|
| 4,722,656 | 2/1988 | Naab | 414/21 X |
| 4,722,658 | 2/1988 | Wurtz et al. | 414/408 |
| 4,726,729 | 2/1988 | Olson et al. | 414/730 X |
| 4,824,315 | 4/1989 | Naab et al. | 414/409 X |
| 4,854,406 | 8/1989 | Appleton et al. | 414/406 X |
| 4,889,462 | 12/1989 | Naab et al. | 414/408 |

FOREIGN PATENT DOCUMENTS

| | | | |
|---|---|---|---|
| 173180 | 11/1987 | European Pat. Off. . | |
| 3517491 | 11/1986 | Fed. Rep. of Germany | 414/408 |
| 15014 | 2/1977 | Japan | 298/22 C |
| WO85/03689 | 8/1985 | PCT Int'l Appl. | 414/408 |

*Primary Examiner*—Frank E. Werner

*Attorney, Agent, or Firm*—H. Gibner Lehmann; K. Gibner Lehmann

[57] ABSTRACT

A safety circuit arrangement for use with lifting/tilting devices for emptying garbage containers into garbage trucks. To prevent the manipulation of switches such as flap and acknowledgement signal switches provided on such lifting/tilting devices, for the safety of the operating personnel, these switches are connected to a current flow monitor 25 which is electrically connected to an automatic control unit 30 for the automatic emptying of the garbage containers. This current flow monitor 25 transmits a "clear" signal to the automatic control unit 30 only if the flap and acknowledgement switches 16 and 11 are in their intended positions. In addition, other safety switches may be provided, such as lower and upper reference switches 9 and 32, respectively and a barrier switch 13.

16 Claims, 7 Drawing Sheets

SAFETY CIRCUIT ARRANGEMENT FOR LIFTING/TILTING OR TILTING DEVICES

CROSS REFERENCES TO RELATED APPLICATIONS

The present application claims priority under 35 USC 119, of West German Application No. P 39 10 660.8 filed Apr. 3, 1989.

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to lifting/tilting devices, and more particularly to automated devices of this kind which are employed to raise garbage bins into the pour-in opening of a garbage truck.

2. Description of the Related Art Including Information Disclosed Under 37 CFR §§1.97–1.99

More specifically, the invention relates to a safety circuit arrangement for lifting/tilting or tilting devices to empty containers of different sizes, in particular for lifting/tilting devices of garbage trucks with a control mechanism for the automatic emptying of the containers into collection bins and with at least two system contacts or system switches, in particular flap or acknowledgement signal switches, electrically connected, directly or indirectly, to the automatic control unit and actuated by the containers.

Garbage trucks are usually equipped with so-called automatic systems which, after the containers have been hung into the lifting/tilting device, raise them, empty them, possibly shake them and put them back on the ground. This automatic system is activated by a flap switch disposed on the lifting/tilting frame when the garbage container is hanging in the lifting/tilting frame and actuates the flap switch. The automatic system is then activated by a hand switch on the garbage truck. Under some circumstances, both the hand switch and the flap switch can be manipulated by the garbage collectors in order to accelerate the emptying process. Since such manipulation also puts the respective safety devices out of operation, the risk of accidents is considerably increased for the garbage collectors.

Known from EP-PS 1731 80 is a lifting/tilting device for emptying containers which is equipped with electric system contacts in the abutment area. Other system contacts are disposed on the center gripping plates of the gripping mechanism. A switching process can be triggered only by the combined actuation of at least three contacts, and such a switching process may consist in that the truck driver in the cab or a garbage collector working on the emptying device is given a signal that the actual emptying process can now be initiated. But it is also possible to utilize the simultaneous actuation of the three contacts for the automatic initiation of the actual emptying process.

But this arrangement still does not meet the desired stringent safety requirements because a manipulation of the system contacts can cause the safety provision to be put out of action again.

SUMMARY OF THE INVENTION

Therefore, the object of the present invention is a safety circuit arrangement for garbage truck lifting/tilting devices which avoids the disadvantages of the known devices and renders a manual manipulation or override of the automatic control more difficult.

This problem is solved by a safety circuit arrangement according to the appended claim 1.

To make nearly impossible, the manipulation of the system contacts or switches, which preferably are acknowledgement signal switches or flap switches, they are connected to a current flow monitor which constantly checks the intended status of these switches and transmits a "clear" signal to the automatic control unit only if the switches are in their intended positions at the correct times. In case the acknowledgement signal switch is on permanently, for instance, there is not transmitted to the automatic control unit, such a "clear" signal.

The acknowledgement signal switch, as well as the flap switch, is actuated by the garbage bin. Preferably, the acknowledgement signal switch is mounted with respect to the lifting/tilting device so as to be actuated by the rim of the bin. The flap switch and the acknowledgement signal switch interact in such a manner that no automatic operation is possible in the absence of the correct switch signal either from the flap switch or from the acknowledgement signal switch. The flap switch is actuated by the approach of the container to the lifting frame and gives the starting signal for the initiation of the automatic cycle to a controller. The control signal is transmitted via an integrated time delay circuit so that the start of the lifting motion is cleared with an initial delay. If the flap switch should have been brought into working position manually, no automatic operation would be possible due to the absence of the signal from the acknowledgement signal switch. While the lifting/tilting device starts to operate, it stops when it reaches a certain reference elevation.

In case the flap switch was actuated by the wall of a large garbage can, the circuit arrangement provides for the lifting/tilting device to be raised only by a certain amount. If then the acknowledgement signal switch fails to be actuated because, for instance, a large container is involved whose rim cannot yet switch the acknowledgement signal switch in this position of the lifting/tilting device, the latter stops. An undesired automatic emptying of large containers is thus prevented.

The safety circuit arrangement may yet be improved by providing additional switches which either prevent the automatic control unit from being activated in the first place or stop the automatic emptying process if the switches were not actuated in the intended manner. Accordingly, at least one upper reference switch, actuatable during the first up-travel of the lifting/tilting device, and at least one lower reference switch, actuatable during the respective lowering of the lifting/tilting device, are electrically connected to the current flow monitor. In addition, at least one barrier switch, actuatable upon the lowering of the safety barriers, is electrically connected to the current flow monitor, giving a "clear" signal to the automatic control unit only after all these switches are in their intended positions.

Moreover, the current flow monitor may be designed to check in which gear the vehicle's gearshift is. In this case, a "clear" signal is sent to the automatic control unit only if the vehicle is not in reverse gear.

In order to be able to interrupt the automatic process in dangerous situations, at least one emergency stop switch is provided between the current supply and the automatic control unit. These emergency stop switches are wired in series with the emergency stop switches mounted to the garbage truck.

According to another embodiment, the upper reference switch is connected to the ignition circuit of the garbage truck's engine. If the garbage truck's ignition circuit was interrupted, the upper reference switch must be actuated anew. This is accomplished by moving the lifting/tilting device to the upper reference point.

Another embodiment provides for an additional switch gear to be disposed between the upper reference switch and the current flow monitor, latching in after the initial actuation of the upper reference switch. If, in this arrangement, the garbage truck's ignition circuit is interrupted, this switch gear is shut off also so that the latched-in status is cancelled. After re-ignition it is then again necessary to approach the upper reference point so as to actuate the upper reference switch and allow this additional switch gear to latch in again.

Preferably, the lower reference switch is connected to a reverse travel safety device of the garbage truck. Such a reverse travel safety device consists essentially of a warning signal to tell the garbage truck driver that the backing up of the garbage truck represents a dangerous situation.

In lifting/tilting devices which, juxtaposed, can singly empty a small and jointly a large container, an additional locking switch is connected to the switch gear and is actuated whenever the two lifting/tilting devices are joined mutually by a mechanical or electrohydraulic locking system.

Preferably, all switches mentioned may consist of so-called proximity switches because they offer the advantage of not being fixable manually in one position as easily as mechanical ones. These proximity switches are mounted to the lifting/tilting device(s) or to the garbage truck and are actuated by appropriate actuating elements such as switching brackets.

The upper reference switch is mounted in the upper lifting range of the lifting/tilting device next to the pour-in opening on the dump housing, preferably above the pivot shaft of the lifting/tilting device. The proximity switch is aligned so as to be actuated as soon as the upper end of the lifting/tilting frame reaches the upper reference point. If applicable and desired there may be provided on the lifting/tilting frame an additional plate which interacts with the upper reference switch.

The lower reference switch is mounted in the lower lifting range of the lifting/tilting device to the lifting-/tilting frame and is actuated when the lifting/tilting frame approaches the lower reference point. The lower reference switch may be located wherever it can be actuated by the lifting/tilting frame upon reaching the lower reference point. Preferably, the lower reference switch is mounted so as to be opposite an actuating element when the lower reference point is reached by the lifting/tilting frame.

The acknowledgement signal switch is mounted to the lifting beam so that it can be actuated when the container to be emptied is hung in. The flap switch is mounted to the front of the lifting beam and is actuated as soon as the wall of the container to be emptied makes contact.

The barrier switches are mounted to the dump housing in the upper pivoting range near the axis of rotation of the barrier and are actuated by the latter as soon as it has swung down from its normal position.

It is of particular advantage for the application of the arrangement to realize the current flow monitor and the automatic control unit in a single electronic component. This improves safety also due to the fact that no long cables have to be laid between these devices which so often can be the cause of malfunctions in the rough, every-day application of the lifting/tilting or tilting devices.

The operating mode of the safety circuit arrangement is described in greater detail in the following.

Prerequisite for the operation of the safety circuit arrangement is to switch the ignition on first. Then, prior to the first emptying operation, the barriers which limit the pivoting range of the lifting/tilting device laterally must be swung down into their end position. In so doing, the two barrier switches are actuated, transmitting appropriate signals to the automatic control unit or current flow monitor. If proximity switches are used, one switch is preferably damped and one switch undamped when the barriers are lowered so that manipulating these two switches is not possible.

By operating a hand switch the garbage collector must then raise the lifting/tilting device to an upper reference point. There the upper reference switch is actuated, thereby activating the current flow monitor which subsequently checks constantly whether the lower reference switch, the acknowledgement signal switch, the flap switch and the barrier switch or switches are in their intended states. If the current flow monitor finds that all these switches are in their intended states, an appropriate "clear" signal is sent to the automatic control unit. The upper reference point must be approached every time the garbage truck's engine is started anew. Otherwise the current flow monitor is not activated and the respective "clear" signal is not received by the automatic control unit so that it cannot be activated.

The end of this current flow check may be indicated to the garbage collector either acoustically or optically, who then lowers the lifting/tilting device to a lower reference point by operating an appropriate hand switch. The lower reference switch, connected to a reverse travel safety device of the garbage truck, is disposed in the lower reference point. When the driver shifts into reverse gear, the reverse travel safety device informs the driver acoustically or optically that from this time on he must not back the garbage truck up because the automatic system is now ready to operate, or the lifting frame is in its lowest position. In case the lower reference point was not approached for whatever reason, the automatic control unit cannot be activated.

After these preparations the automatic control unit can be turned on by pushing a button and the first container can be brought or driven to the lifting/tilting frame. In this process the container wall pushes against the flap switch and the container rim, after a short upward travel, against the acknowledgement signal switch. If the acknowledgement signal switch is actuated before the flap switch, the automatic control unit cannot be activated. If only the flap switch is actuated at the reception level of small containers while the acknowledgement signal switch is not, the lifting/tilting device will travel upwardly by a certain amount only and stop. In this case the lifting/tilting device attains only a level below the reception level of a big container. It is made certain in this manner that big containers cannot be emptied automatically. If the flap switch is actuated unintentionally by an operator, the same effect ensues. An endangerment of the operator is made virtually impossible due to the short stroke.

After emptying, the container is automatically deposited on the ground again. Should the garbage collector remove the container prematurely from the lifting/tilting device, both the acknowledgement signal switch and the flap switch are actuated, thereby taking the "clear" signal away from the automatic control unit which immediately interrupts the automatic operation and goes into stop position. In this case, the entire lifting/tilting device must be lowered again manually to the lower reference point before the next emptying operation so that the lower reference switch located there is actuated anew. The latter then sends an appropriate signal to the automatic control unit so as clear it for continued operation. Then the automatic control unit must be turned on again by pushing a button.

Every manual intervention in the automatic emptying process leads to an interruption of the emptying process and requires that the lower reference point be approached again, thereby actuating the lower reference switch.

In garbage trucks with two dump holes, a safety circuit arrangement of its own is provided for each lifting/tilting device.

In garbage trucks with a twin dump hole with folding arms to receive big garbage containers the safety circuit arrangement is also provided in duplicate. In addition, the two lifting/tiling devices are equipped with a locking mechanism, by means of which both lifting/tilting devices can be joined to each other mechanically. This locking mechanism is coupled to a locking switch which likewise is connected electrically to the circuit arrangement. The automatic control units are deactivated when the two lifting/tilting devices are joined to each other to empty large containers. Since the automatic control units are not being used in this case, the two barriers may also be swung up into their starting position for emptying big containers.

Other features and advantages will hereinafter appear.

BRIEF DESCRIPTION OF THE DRAWINGS

Exemplary embodiments of the invention are described below in greater detail with reference to the drawing in which.

DESCRIPTION OF THE PREFERRED EMBODIMENT

Figure 1:
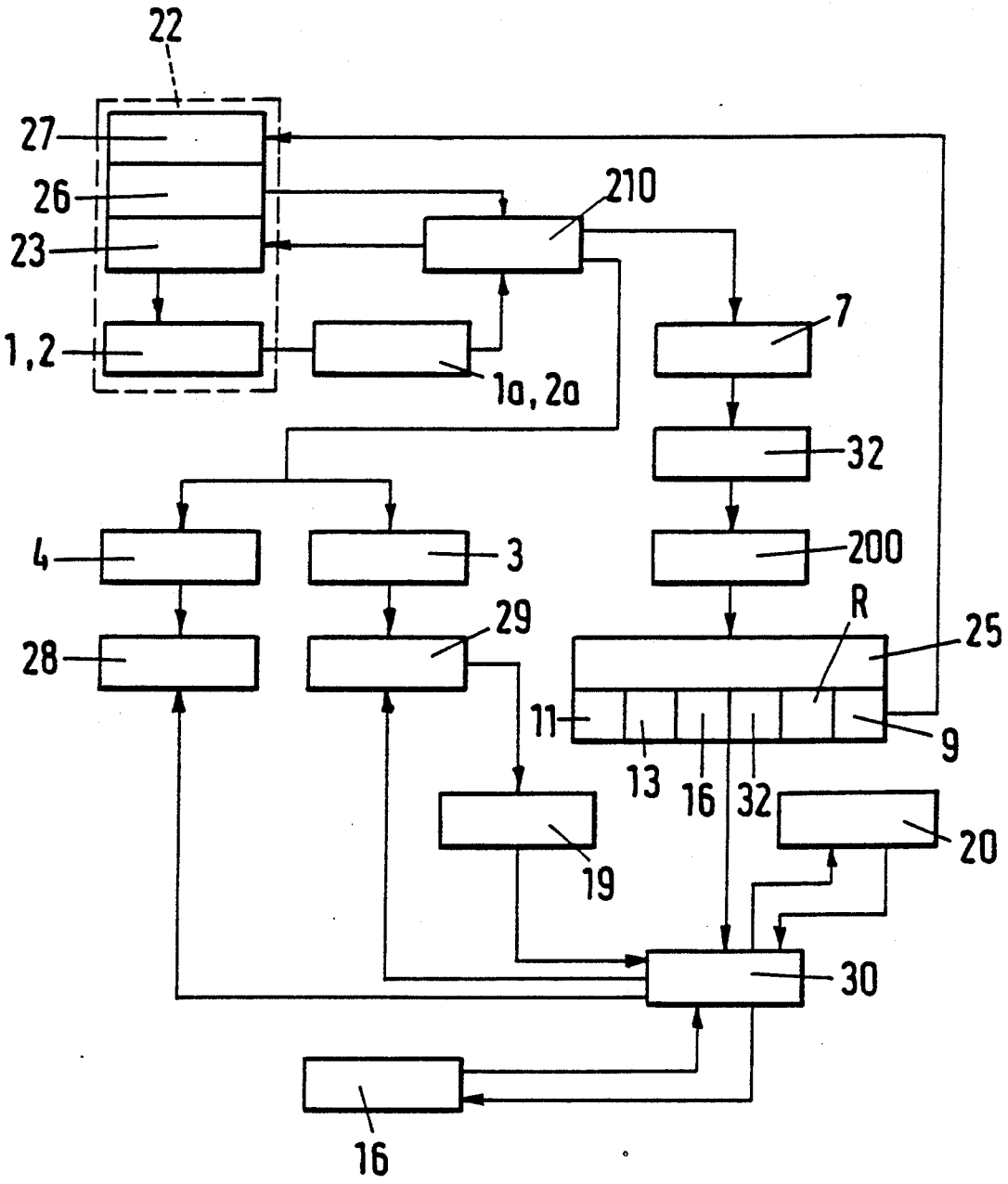
FIG. 1 shows a block circuit diagram of the safety circuit arrangement for a single dump hole.

FIG. 1 shows the safety circuit arrangement according to the invention for a single dump hole. The garbage truck 22 has a power supply 23, an ignition circuit 26 for the garbage truck's engine and a reverse travel safety device 27 in the form of a warning signal lighting up in the driver's cab. A line wired across the ignition circuit 26 goes from the power supply 23 of the vehicle 22 directly to the switch gear 210 of the lifting/tilting device. A second electric line leads from the power supply 23, via two emergency switches 1 and 2 mounted to the vehicle and two more emergency switches 1*a*, 2*a* mounted to the device, to the switch gear 210 and thence back to the vehicle 22. It is from this switch gear 210 that a line goes to the switch 7 by means of which the automatic control unit 30 can be activated manually. However, the actuation of switch 7 becomes effective only when the upper reference point is approached by means of the hand switch 3 which acts upon the solenoid valve 29 responsible for raising the lifting/tilting device. When the upper reference point has been reached, the upper reference switch 32 is actuated. This causes a switch gear 200 to latch in, clearing the current path to the current flow monitor 25 which checks whether the lower reference switch 9, the acknowledgement signal switch 11, the flap switch 16, the upper reference switch 32 and one of the barrier switches 13 all are in their intended positions. This also includes that the current flow monitor checks and determines that the garbage truck is not in reverse gear. This is indicated by R in FIG. 1.

If it is found that all switches are in their intended positions and no other manual actuation is taking place, an appropriate "clear" signal is transmitted to the automatic control unit 30.

The lower reference switch 9 is connected, via another line, to the reverse travel safety device 27 which indicates to the driver in accordance with the position of switch 9 whether he may or may not back the vehicle up.

The latch-in of the switch gear 200 is interrupted upon any interruption of the ignition circuit 26 and must be re-established by approaching the upper reference point again.

The current flow monitor 25 takes the "clear" signal away from the automatic control unit also when a signal from the switches 3, 4, 9, 11, 16, and 32 either is present permanently, i. e. at times when it should not be there, or does not arrive at the proper time. In this case, either the started emptying operation is completed or, preferably, this emptying operation is interrupted at once.

In spite of the fact that the "clear" signal from the switch 32 or from the current flow monitor 25 is present, the automatic control unit 30 is not ready to function. For, the automatic control unit 30 is also connected to the barrier switch 20 which is inserted between the switch gear 210 and the automatic control unit 30. Only after the barrier switch 22 was actuated by swinging down the barriers is an appropriate "clear" signal present at this point also. Simultaneous with clearing the automatic control unit 30 a signal is also transmitted to the solenoid 28. This signal is effective as long as the automatic control unit is cleared.

The actuation of the flap switch causes a signal to be transmitted to the solenoid valve 29 via the switch gear 210 and the automatic control unit 30. This valve is responsible for raising the lifting/tilting device and, in addition, gives the command to the automatic control unit 30, via the timer 19, to control the emptying process timewise.

Upon the conclusion of the emptying process, the signal is removed by the automatic control unit 30 from the solenoid 29 and the lowering of the lifting/tilting device is initiated.

Summarizing, the following switching sequence is required for an automatic emptying cycle:

Actuate switch 16.
Actuate switch 11.
Deactuate switch 9.
Actuate switch 32.
Deactuate switch 32.
Actuate switch 9.
Deactuate switch 11.
Deactuate switch 16.

A deviation from this sequence is recognized as an error by the current path monitor 25 and leads to the shut-off of the "clear" signal.

Figure 2:
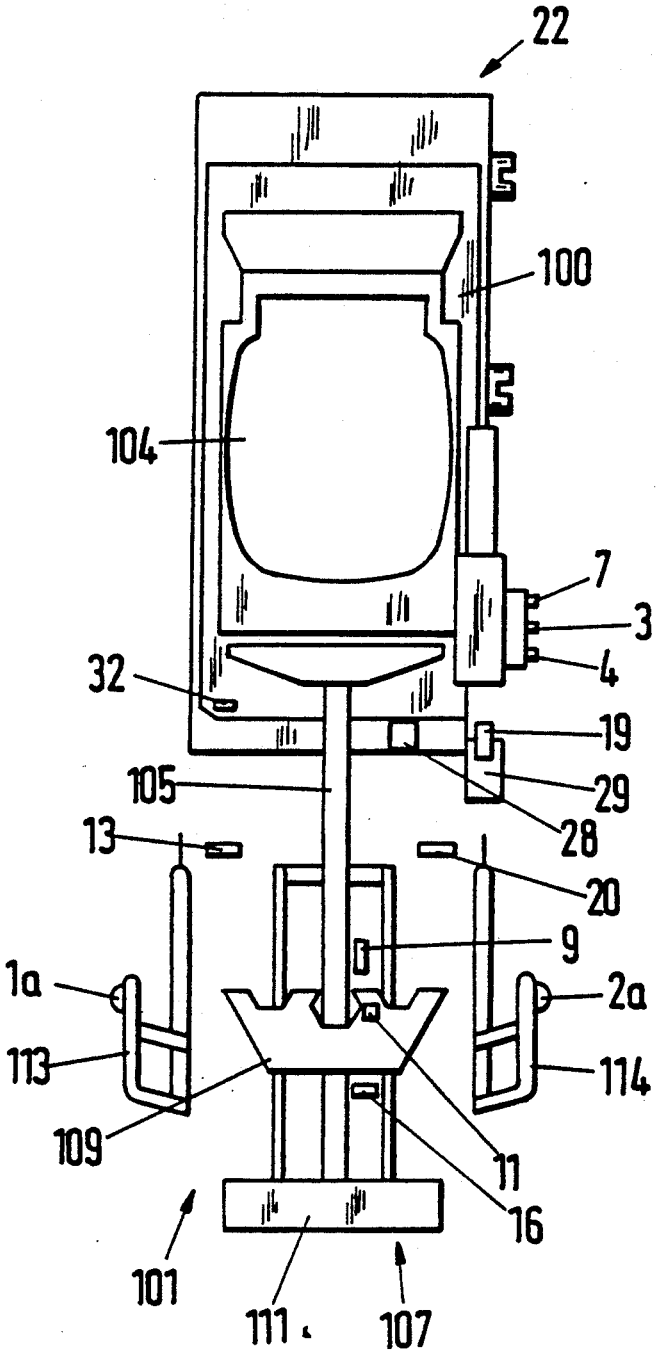
FIG. 2 is a rear view of a garbage truck with a single dump hole.

FIG. 2 shows the rear view of a garbage truck with a single dump hole. The garbage truck 22 is only shown schematically, as are the lifting/tilting device 101 mounted to it and arrangement of the switches. The lifting/tilting device 101 has a dump housing 100 with a pour-in opening 104. Disposed on the lower right next to the pour-in opening 104 is a group of keys with the push buttons 7, 3 and 4. Button 7 serves to turn the automatic control unit 30 on. Buttons 3 and 4 serve the manual raising and lowering of the lifting/tilting device 101 which is located below the pour-in opening 104. This lifting/tilting device has a lifting cradle 107 with a lifting beam 109 and an abutment plate 111 to seat a garbage can (not shown). The entire lifting cradle 107 is fastened to swinging arm 105. Disposed on both sides next to the lifting cradle 107 are safety barriers 113, 114. Each safety barrier 113, 114 supports an emergency switch 1*a*, 2*a*.

The upper reference switch 32 is mounted to the dump housing below the pour-in opening 104. Below it is the barrier switch 13 which is actuated when the barrier 113 is swung down. Provided on the right side at the corresponding spot is a barrier switch 20, actuated by the barrier 114. Furthermore, the lower reference switch 9, actuated when the lower reference point is reached, is mounted to the lifting beam 109. Also disposed on the lifting beam 109 are both the flap switch 16 and the acknowledgement signal switch 11.

Figure 3:
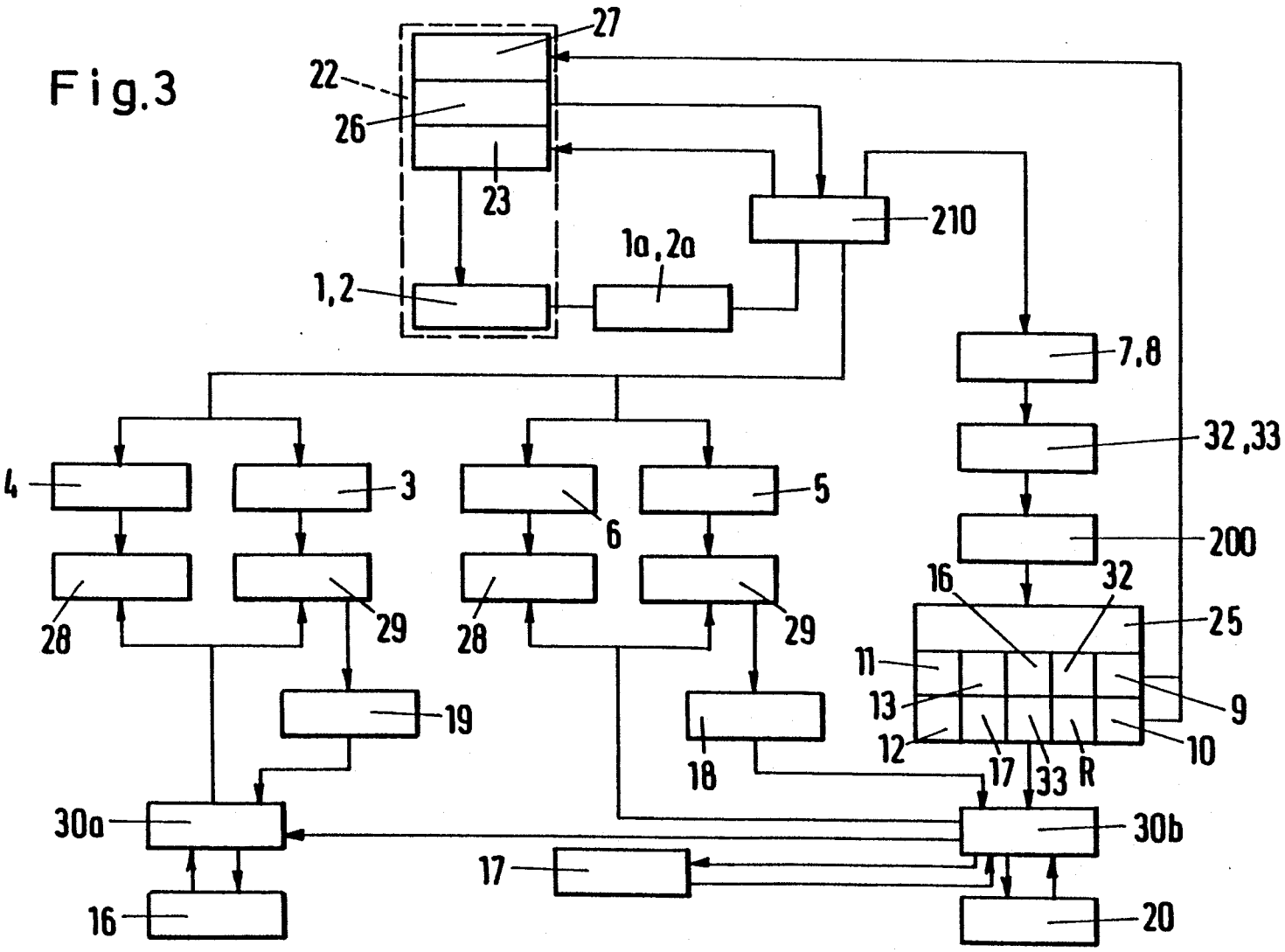
FIG. 3 is a block circuit diagram for a truck with dual dump holes.

FIG. 3 shows the safety circuit arrangement for dual dump holes. Corresponding to FIG. 1, the garbage truck 22 also has a power supply 23, an ignition circuit 26, and a reverse travel safety device 27. A line, wired through the ignition circuit 26, goes from the vehicle's power supply 23 directly to the switch gear 210 of the two lifting/tilting devices.

A second electric line again leads from the power supply 23, via two emergency switches 1 and 2, to the switch gear 210 and thence back to the vehicle 22. From this common switch gear 210 a line goes to switch 7 or 8, respectively, by means of which the automatic control unit 30*a* or 30*b*, respectively, can be activated manualy. 30*a* designates the automatic control unit for the left lifting/tilting device and 30*b* the automatic control unit for the right one. Accordingly, switch 7 is provided to actuate the left lifting/tilting device and switch 8 to actuate the right one. However, the actuation of the switches 7 and 8 becomes effective only after the upper reference point has been approached by means of the hand switch 3 for the left lifting/tilting device or 5 for the right one. Each lifting/tilting device of the dual dump hole arrangement is operated and controlled independent of the other.

Upon reaching the upper reference point the upper reference switches 32, 33 are actuated. This causes a switch gear 200 to latch in, clearing the current path to the current flow monitor 25 which checks whether the lower reference switches 9, 10, respectively, the acknowledgement signal switch 11, 12, respectively, the flap switch 16, 17, respectively, the upper reference switch 32, 33, respectively, and the barrier switch 13 are all in their intended states. It is further checked and determined that the garbage truck is not in reverse gear, which is shown by R.

If it is determined that all switches of both lifting/tilting devices are in their intended states and that no manual operation is taking place on these lifting/tilting devices, an appropriate "clear" signal is transmitted to the respective automatic control unit 30*a* (left automatic control unit) and 30*b* (right automatic control unit), respectively.

The lower reference switches 9, 10 are connected via another line to the reverse travel safety device 27 which tells the driver, in accordance with the position of the switches 9, 10, whether or not he may back the vehicle up.

Upon any interruption of the ignition circuit 26 the latch-in of the switch gear 200 is interrupted and must be re-established by approaching the upper reference point again.

The current flow monitor 25 takes the "clear" signal away from the automatic control units 30*a*, 30*b* also if a signal from the switches 3, 4 or 5, 6, 9 or 10, 11 or 12, 16 or 17, and 32 or 33 is either present constantly, i. e. at times it should not be there, or does not arrive at the proper time. In this case, the started emptying operation is either completed or, preferably, the emptying process of both lifting/tilting devices is interrupted at once.

The two automatic control units 30*a*, 30*b* are additionally connected to the barrier switch 20 which is inserted between the switch gear 210 and the automatic control unit 30*b*. After the barrier switch 20 was actuated by swinging the barriers down, this point also carries an appropriate "clear" signal. If the barrier switch 20 was not actuated, neither the automatic control unit 30*a* nor the automatic control unit 30*b* are ready to function.

Simultaneous with clearing the automatic control units 30*a* 30*b*, respectively, a signal is also transmitted to the respective solenoid valve 28. This signal is present as long as the respective automatic control units 30*a*, 30*b* are cleared.

Upon the actuation of the flap switches 16 or 17, an appropriate signal is sent to the respective solenoid valve 29 via the respective automatic control unit 30*a*, 30*b*. These valves are responsible for the raising of the lifting/tilting devices and, in addition, give the command to control the emptying process timewise to the automatic control units 30*a*, 30*b*.

After the conclusion of the emptying operation, the signal is taken away from the solenoid valve 29 by the respective automatic control unit, and lowering the lifting/tilting devices is initiated.

The switching sequence listed in connection with FIG. 1 also applies to this embodiment for each individual lifting/tilting device.

Figure 4:
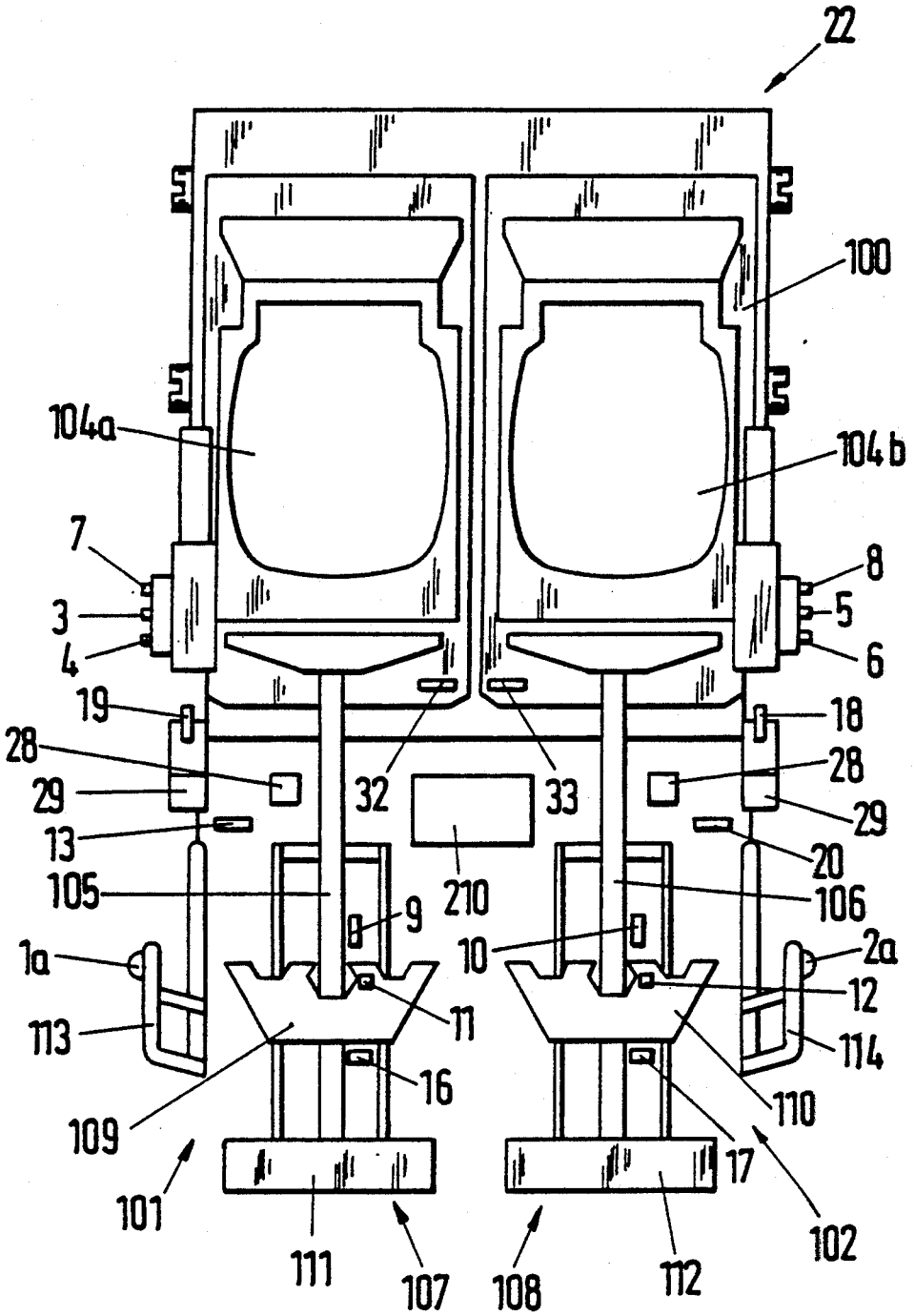
FIG. 4 is a rear view of a garbage truck with dual dump holes.

FIG. 4 shows the rear view of a dump truck 22 with such dual dump holes. Again, this figure also shows merely schematically the lifting/tilting devices 101, 102 and the arrangement of the switches.

The lifting/tilting device has a dump housing 100 with the two pour-in openings 104*a* and 104*b*. Disposed on the lower left and right next to these pour-in openings 104*a*, 104*b* is a group of keys, each with the push buttons 7, 3, 4 and 8, 5, 6, respectively. The push buttons 7, 8 serve the activation of the automatic control units 30*a* and 30*b*, respectively. The switches 3, 4 and 5, 6 serve the manual raising and lowering of the lifting/tilting devices 101, 102, respectively, which are shown below the pour-in openings 104*a*, 104*b*. Each lifting/tilting device 101, 102 has a lifting cradle 107, 108, respectively, with a lifting beam 109, 110, respectively, and an abutment plate 111, 112, respectively, to seat a garbage can (not shown). Each lifting cradle 107, 108 is fastened to a swinging arm 105, 106, respectively. Mounted on both sides next to the two lifting cradles 107, 108 are safety barriers 113, 114 which support an emergency switch 1*a* and 2*a*, respectively.

Disposed on the dump housing 100 below the pour-in openings 104*a*, 104*b* is the upper reference switch 32 for the left lifting/tilting device and the upper reference switch 33 for the right lifting/tilting device. On the outside of the dump housing 100 are the barrier switches 13 and 20 which are actuated by the lowering of the barriers 113, 114.

The lower reference switches 9, 10, actuated upon reaching the lower reference points by the lifting beams 109, 110, respectively, are located in the lower area of the lifting/tilting device.

A flap switch 16, 17 is mounted to the front of each lifting beam 109, 110. An acknowledgement signal switch 11, 12, actuated by the rim of the container after having been hung into the lifting beam, is each mounted to the sides of the two lifting beams 109, 110.

Figure 5:
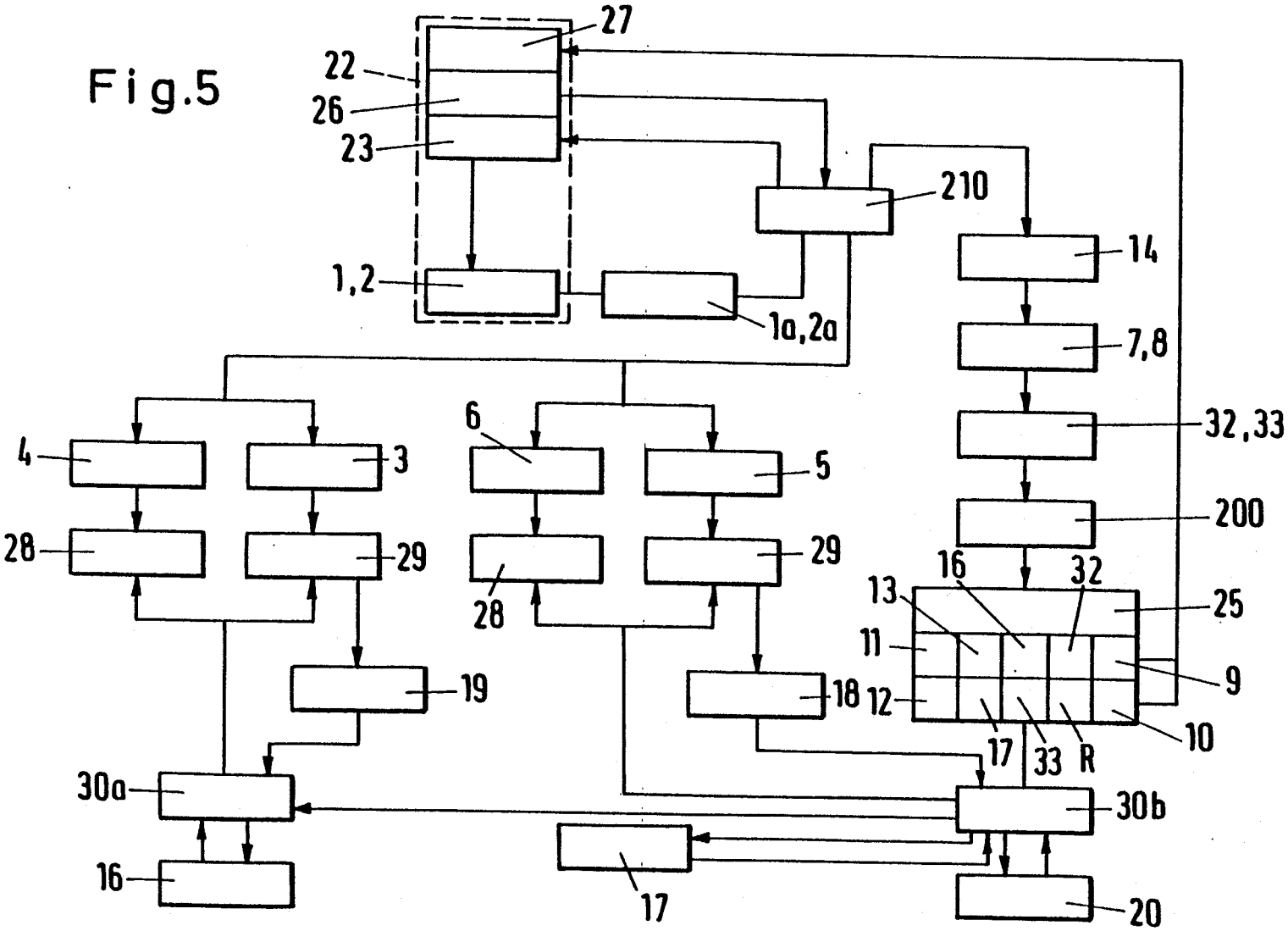
FIG. 5 is a block circuit diagram for a split comb type dump hole.

In FIG. 5 is shown the block circuit diagram for a split comb type dump hole (twin dump). This block circuit diagram corresponds to that of FIG. 3 with the difference that an additional locking switch 14 is provided. This locking switch 14 precedes the automatic turn-ons 7 and 8. If the locking switch 14 is not actuated, the automatic control units 30*a*, 30*b* can be activated, provided the other functions are met. If the locking switch 14, which is actuated when the two lifting-/tilting devices are being joined mechanically, is on, the two automatic control units cannot be used because it is intended in this case to empty a big garbage can. It is prevented in this manner that big garbage cans are emptied automatically also. Emptying big cans can be accomplished by manual operation only.

Figure 6:
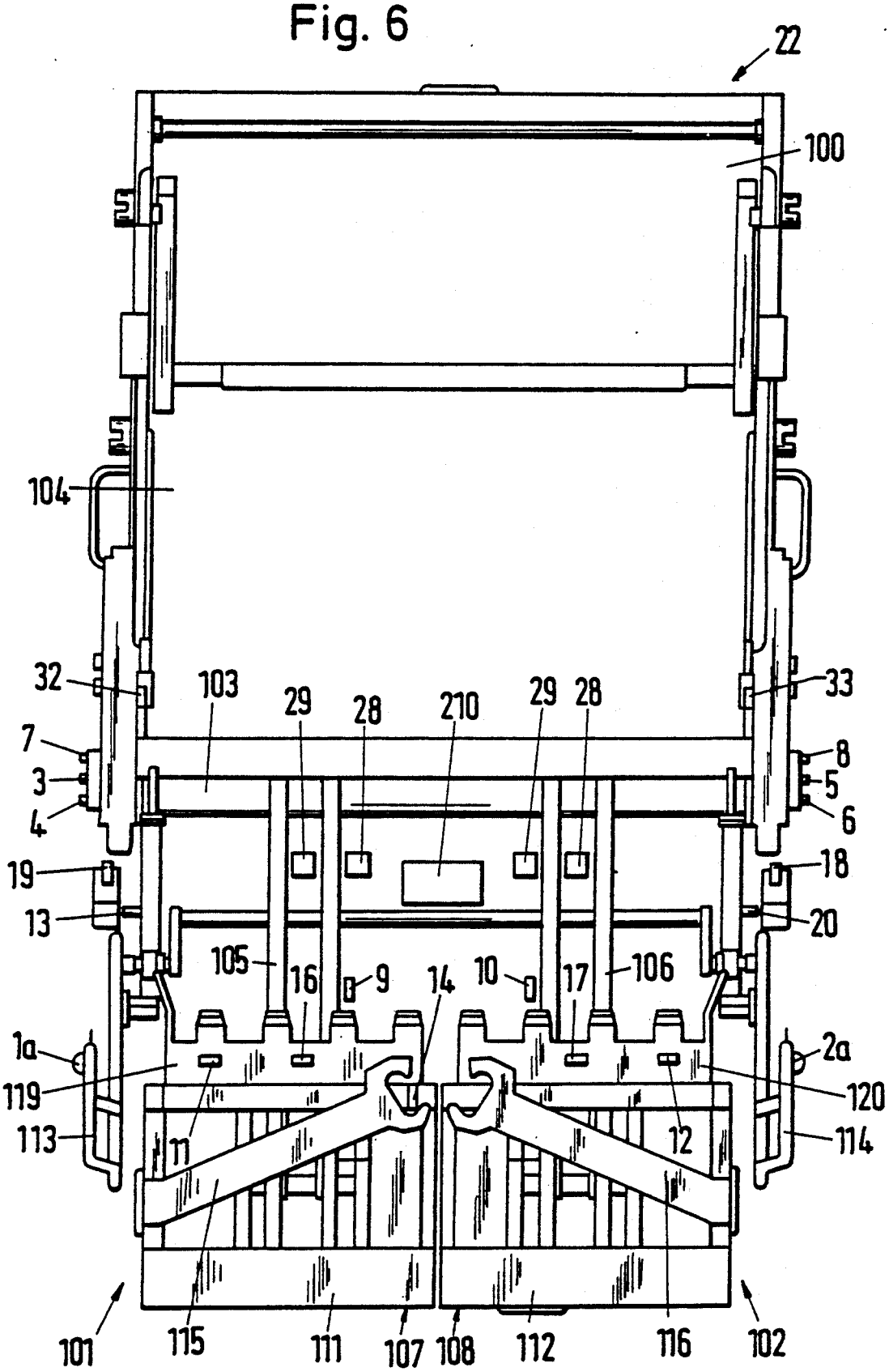
FIG. 6 is a rear view of a garbage truck with a split comb type dump hole.

FIG. 6 shows the rear view of such a split comb type dump hole. Contrary to the previous embodiments, each lifting/tilting device 107, 108 has two gripping arms to accept large garbage containers. Both lifting-/tilting devices 107, 108 are locked to each other mechanically or electrically, thereby actuating the switch 14.

Each individual lifting/tilting device 107, 108 has a comb 119, 120, to which are mounted flap switches 16, 17 as well as acknowledgement signal switches 11, 12, respectively. Arrangement and operating mode of these and the other switches are the same as in the embodiment shown in FIG. 4.

Figure 7:
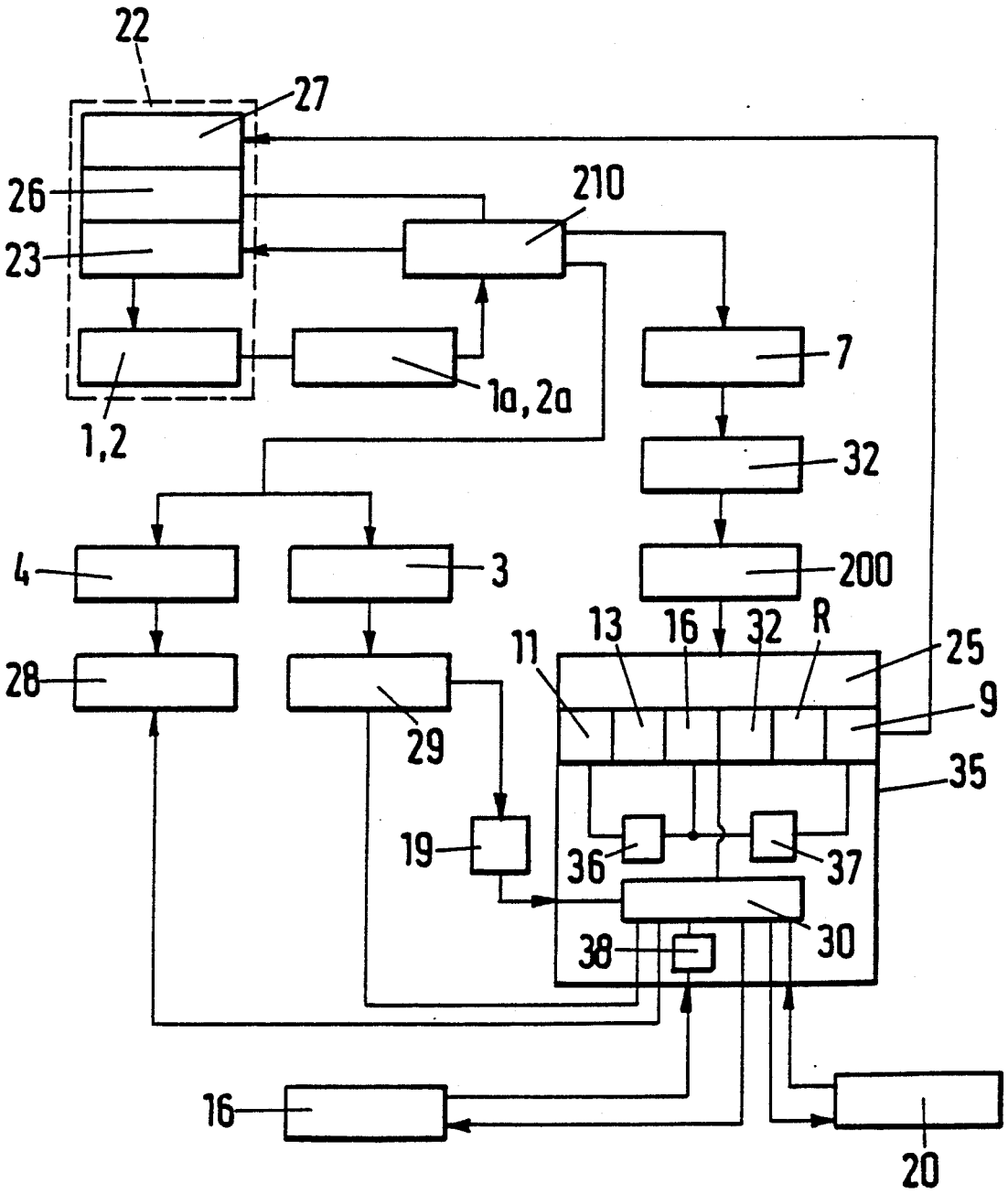
FIG. 7 is a block circuit diagram of the safety circuit arrangement for a single dump hole according to a further development of the arrangement of FIG. 1.

FIG. 7 shows another circuit arrangement according to the invention which is a further development of the arrangement per FIG. 1. Differing from the latter, the current flow monitor 25 and the automatic control unit 30 are here combined in a single electronic component 35 with an I/O board (not shown).

In addition, a timer each, 36 and 37, is inserted between the flap switch 16 and the acknowledgement signal switch 11, as well as between the flap switch 16 and the lower reference switch 9. With the timers it can be preset that, with a possible presettable time interval, a certain actuating sequence of the switches 9, 11, 16 must be present, otherwise the automatic control unit would be shut off. $\Delta t$ is preferably in the 300 ms range. The timers provide that, after the switch 16 has been actuated, the switch 11 must be actuated within $\Delta t$ and the switch 9 must be reversed for the automatic control to remain in operation. Two timers are provided because the sequence of motions is exactly reversed during the upswing and downswing of the tilting device.

Furthermore, another timer 38 is inserted between the flap switch 16 and the automatic control unit 30. This causes the automatic control unit 30 to be cleared, after the actuation of switch 16, only after a possibly presettable time span, e. g. 200 ms, has elapsed, thus making the various motion cycles purposefully presettable.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

List of reference symbols:

1—Emergency stop switch
1*a*—Emergency switch
2—Emergency stop switch
2*a*—Emergency switch
3—Left raising switch
4—Left lowering switch
5—Right raising switch
6—Right lowering switch
7—Left automatic switch
8—Right automatic switch
9—Left lower reference switch
10—Right lower reference switch
11—Left acknowledgement signal switch
12—Right acknowlegement signal switch
13—Left barrier switch
14—Locking switch
16—Left flap switch
17—Right flap switch
18—Right timer release
19—Left timer release
20—Right barrier switch
22—Vehicle
23—Power supply
25—Current flow monitor
26—Ignition
27—Reverse travel safety device
28—Solenoid valve, lowering
29—Solenoid valve, raising
30, 30*a*, 30*b*—Automatic control unit
32—Left upper reference switch
33—Right upper reference switch
36—Timer
37—Timer
38—Timer 100—Dump housing
101—Left single lifting/tilting device
102—Right single lifting/tilting device
103—Common pivot shaft
104*a*—Pour-in opening
104*b*—Pour-in opening
105—Left swinging arm
106—Right swinging arm
107—Left lifting cradle
108—Right lifting cradle
109—Left lifting beam
110—Right lifting beam
111—Left abutment plate
112—Right abutment plate
113—Left barrier
114—Right barrier
115—Gripping arm for big containers
116—Gripping arm for big containers
119—Left comb
120—Right comb
200—Switch gear
210—Switch gear

What is claimed is:

1. Safety circuit arrangement for a lifting/tilting device for emptying a container into a garbage truck (22), said circuit arrangement having an automatic control unit (30) for regulating an automatic emptying cycle of the container into a collection bin (100) of said truck (22), and said safety circuit arrangement having a first switch (16) and a second switch (11), which are mounted on said lifting/tilting device and which are each actuatable to intended predetermined statuses in response to a container being correctly placed and correctly positioned upon said lifting/tilting device, characterized in that said switches (16, 11) are connected to an electrical current flow monitor means (25) which continuously functions and which is electrically connected to said automatic control unit (30), and which monitor means continuously checks and continuously oversees the said intended predetermined statuses of the switches (16, 11) and transmits an operation-rendering signal to said automatic control unit (30) only during such times that the said switches (16, 11) are both disposed in said predetermined respective statuses corresponding to said correct positioning of the container on said lifting/tilting device.

2. Arrangement according to claim 1, wherein said truck and said lifting/tilting device having relatively movable parts, and further including an upper reference switch (32), actuatable by the initial upward motion of the lifting/tilting device (101), and a lower reference switch (9), actuatable by the lowering of the lifting/tilting device (101), said reference switches (32, 9) being carried by said movable parts and being connected electrically to the current flow monitor means (25), said lower and upper reference switches (9, 32) sequentially monitoring the movement of one of said parts past the other of said parts, and being operable to either supply or interrupt said operation-rendering signal to said automatic control unit (30) in response to correct or incorrect movement respectively of said parts.

3. Arrangement according to claim 2, characterized in that the upper reference switch (32, 33) comprises a holding switch which is electrically connected to the ignition circuit (26) of the garbage truck (22), and which holding switch opens when the ignition circuit is interrupted and in turn interrupts said operation-rendering signal to said automatic control unit.

4. Arrangement according to claim 3, characterized in that the upper reference switch (32, 33) includes a switch gear (200) which latches-in after the initial actuation of the upper reference switch (32, 33).

5. Arrangement according to claim 2, characterized in that the lower reference switch (9, 10) is connected to a reverse travel safety device (27) of the garbage truck (22) to provide an indication to the driver that the vehicle should not be driven in reverse when the lower reference switch is disposed in a position of interrupting said operation-rendering signal.

6. Arrangement according to claim 2, characterized in that at least some of the switches (16, 11, 32, 9) are proximity switches.

7. Arrangement according to claim 1, and further including a pair of safety barriers (113, 114) mounted on said truck laterally of the lifting/tilting device (101), said barriers being movable between raised and lowered positions, and a barrier switch (13, 20) on said truck, actuatable by the lowering of the safety barriers (113, 114), said barrier switch (13, 20) being electrically connected to the current flow monitor means (25) and being operable to either supply or interrupt said operation-rendering signal to said automatic control unit (30) in response to a lowered or raised position respectively of at least one of said barriers.

8. Arrangement according to claim 7, and further including an additional barrier switch (13, 20) on said truck, connected electrically to the automatic control unit (30) and being operable to either supply or interrupt said operation-rendering signal to said automatic control unit (30) in response to a lowered or raised position respectively of the other of said barriers.

9. Arrangement according to claim 7, and further including a power supply (23) and a manually operable emergency stop switch (1*a*, 2*a*) disposed between the power supply (23) and the automatic control unit (30), said emergency stop switch being mounted on one of the barriers (113, 114), and arranged to interrupt said operation-rendering signal when said emergency stop switch is activated by operating personnel.

10. Arrangement according to claim 9, and further including additional manually operable emergency stop switches (1, 2) on said truck, one of said first emergency stop switches (1*a*, 2*a*) being connected in series with said additional emergency stop switches (1, 2).

11. Arrangement according to claim 7, characterized in that some of the switches (16, 11, 32, 9, 13, 20) are proximity switches.

12. Arrangement according to claim 1, and further including means on said truck, for monitoring the condition of the gearshift of the truck, said means being electrically connected with the current flow monitor means (25) and being operable to either supply or interrupt said operation-rendering signal from said current flow monitor means to said automatic control unit (30) according to whether or not the vehicle is in reverse gear, said condition monitoring means interrupting said operation-rendering signal when said vehicle is in reverse gear.

13. Arrangement according to claim 1, and further including an additional lifting/tilting device, said devices constituting twin dumps, characterized in that there is additionally provided a manually actuatable locking switch (14) carried by one of the lifting/tilting devices and electrically connected to the current flow monitor means (25) so as to interrupt said operation-rendering signal to the automatic control unit when the two lifting/tilting devices are intended to be moved synchronously, as during emptying of a large container, thereby requiring that such large container be emptied manually in the absence of said operation-rendering signal.

14. Arrangement according to claim 1, characterized in that the current flow monitor means (25) and the automatic control unit (30) are constituted as a single electronic component (35).

15. Arrangement according to claim 1, characterized in that the automatic control unit halts movement of the lifting/tilting device at any time during which the automatic control unit is not receiving the said operation-rendering signal from the monitor means.

16. Arrangement according to claim 1, characterized in that the automatic control unit halts movement of the lifting/tilting device if the lifting/tilting device is in the process of lifting a container and there occurs an interruption in reception of said operation-rendering signal being transmitted from the monitor means to the automatic control unit.

* * * * *